US005139469A

United States Patent [19]

Hennessey et al.

[11] Patent Number: 5,139,469

[45] Date of Patent: Aug. 18, 1992

[54] EXERCISE MACHINE AND TRANSMISSION THEREFOR

[75] Inventors: Richard G. Hennessey, Oaklawn; Joseph A. Soliman, Bolingbrook; Thomas L. Werking, Buffalo Grove, all of Ill.

[73] Assignee: Zurn Industries, Inc., LaGrange, Ill.

[21] Appl. No.: 570,030

[22] Filed: Aug. 2, 1990

[51] Int. Cl.[5] ..... A63B 23/04

[52] U.S. Cl. ..... 482/52; 482/2; 474/88

[58] Field of Search ..... 272/69, 70, 129, 130, 272/73; 474/84, 85, 86-89; 73/379, 381

[56] References Cited

U.S. PATENT DOCUMENTS

| | | | |
|---|---|---|---|
| 3,653,273 | 4/1972 | Albertson et al. | 474/88 |
| 4,708,338 | 11/1987 | Potts | 272/70 |
| 4,938,474 | 7/1990 | Sweeney et al. | 272/73 |

*Primary Examiner*—Stephen R. Crow

*Attorney, Agent, or Firm*—Marshall A. Burmeister

[57] ABSTRACT

An exercise machine and transmission for converting first and second rotary inputs into a single rotary output. The machine has a first input shaft, a second input shaft coupled to the first shaft, and a shell. The shafts are mounted to the shell on a common axis, and one-way clutches are disposed between the shell and each respective shaft. The torques of the first and second shafts in one rotational direction are combined in the shell for single output to a load.

16 Claims, 3 Drawing Sheets

EXERCISE MACHINE AND TRANSMISSION THEREFOR

The present invention relates generally to transmissions for combining the rotational torque from two separate inputs on a common output. In particular, the present invention relates to exercise devices in which the exercise device has two separate input mechanisms which are actuated manually and to transmissions for use with such exercise devices.

BACKGROUND OF THE INVENTION

The power produced by a human being is exerted generally through leg movement or arm movement, and in either case, the power occurs in periodic pulses of energy exerted alternately through the left and right body members. Most exercise machines provide separate input mechanisms for the left and right members, and either provide a separate load to work against the energy supplied by the left and right members, or provide a single load for both left and right members of the body. The present invention is directed towards a transmission particularly suitable for combining the input power generated by the left and right body members on a common rotational output to be applied to a load.

There are some training devices in which the power from the left and right body members are combined mechanically, such as in the cycle training device of Quent Augspurger and Charles H. Bartlett of U.S. Pat. No. 4,817,938 entitled Cycle Training Device in which two peddles are interconnected and attached to a drive sprocket in the conventional manner of a bicycle. A similar bicycle type device is disclosed in U.S. Pat. No. 4,824,102 of Peter K. Lo entitled Exercise Bicycle For Exercising Arms And Legs.

A second mechanism for transmitting two separate inputs to a common load is disclosed in U.S. Pat. No. 4,625,962 of Glenn M. Street entitled Upper Body Exercise Apparatus. In this patent, two forces are generated by the hands of the person exercising, and these forces form inputs which are impressed upon a common load driven by a shaft through two separate one-way clutches. The use of two one-way clutches to couple two inputs to a common load has been used in various types of exercise equipment, including stair climbing exercise machines.

The exercise device of the patent to Street is a relatively large device, and the two one-way clutches and load take up considerable space. Manufacturers of exercise devices have been striving for smaller units and units which will provide better feel and more information to the exerciser. Hence, it is an object of the present invention to provide a transmission, which is of considerably smaller size than those previously known, to convert two separate rotational inputs to a common rotational output.

One-way clutch mechanisms for use in converting two inputs to a common output for an exercise machine are subject to considerable wear. Further, such devices must be constructed in a manner which will not require significant service. It is therefore an object of the present invention to provide a one-way clutch transmission for converting two or more rotational sources of energy to a common output which is capable of withstanding long term use and some abuse.

Most exercise machines employ loads which are operated at a speed significantly higher than the speed that the input member attains under drive by the exerciser. Accordingly, such devices have speed increasing drive trains from the input member to the load. For exercise machines, such drive trains incorporate a transmission for combining torque on two input members on a common output member of greater diameter than the input members. It is an object of the present invention to provide such a transmission in which two increased capacity one-way clutches are incorporated in the larger diameter output member, each of the input members being coupled to the output member through one of the one-way clutches.

One of the common causes for clutch wear is failure to maintain concentricity between the inner and outer races of the clutch. It is therefore one of the objects of the present invention to provide an assembly of two or more one-way clutches provided with improved bearing structure to maintain concentricity between the inner and outer races of the clutches.

Exercise devices tend to be costly, and manufacturers of such devices attempt to contain such costs in order to facilitate sales. It is therefore an object of the present invention to provide a transmission for converting two rotational inputs to a single rotational output at a cost reduced from that of such prior transmissions of comparable torque.

SUMMARY OF THE INVENTION

The objects of the present invention are achieved by an assembly of two high capacity one-way clutches disposed within a common larger diameter outer shell, one portion of the shell being the outer race of the first of the clutches, and another portion of the shell being the outer race of the second of the clutches and the outer portion of the shell accommodating typical drive elements such as a sprocket or sheave. The inner race of the first one-way clutch is mounted on a first input shaft, and the inner race of the second one-way clutch is mounted on a second input shaft. The assembly is provided also with means for maintaining the first and second shafts and shell rotatable about a common axis.

The preferred means for maintaining the first and second shafts and the shell rotatable about a common axis is a first bearing assembly integral with the first one-way clutch and a second bearing assembly integral with the second one-way clutch.

The transmission of the present invention is adapted particularly for use in an exercise machine, such as a step climber, to convert the two reciprocal forces produced by the exerciser into a common rotational output for driving a load. A transmission constructed according to the present invention provides the exerciser with a realistic simulation of the activity, such as stair climbing, and may be rugged, capable of long use without service, and inexpensive. Hence, the transmission of the present invention is especially desirable for such exercise machines.

BRIEF DESCRIPTION OF THE DRAWINGS

The present invention will be more fully understood from the following specification and the accompanying drawings, in which.

DESCRIPTION OF THE PREFERRED EMBODIMENT

Figure 1:
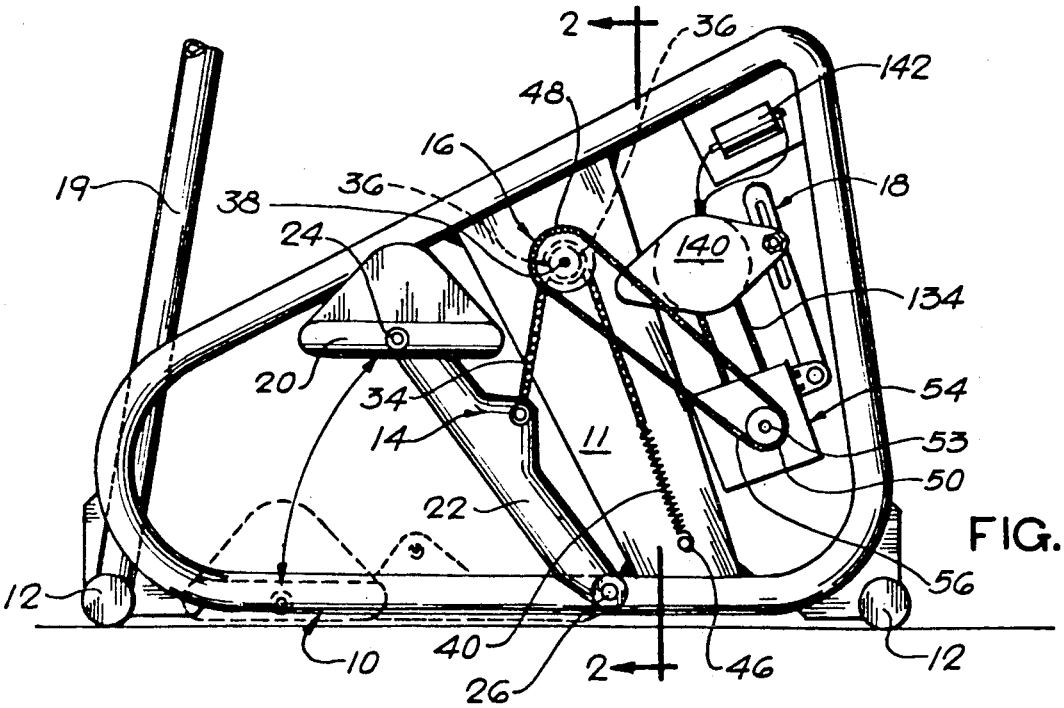
FIG. 1 is a front elevational view of a portion of a stair climbing exercise machine, a decorative panel having been removed to reveal the operating elements of the machine.
Figure 2:
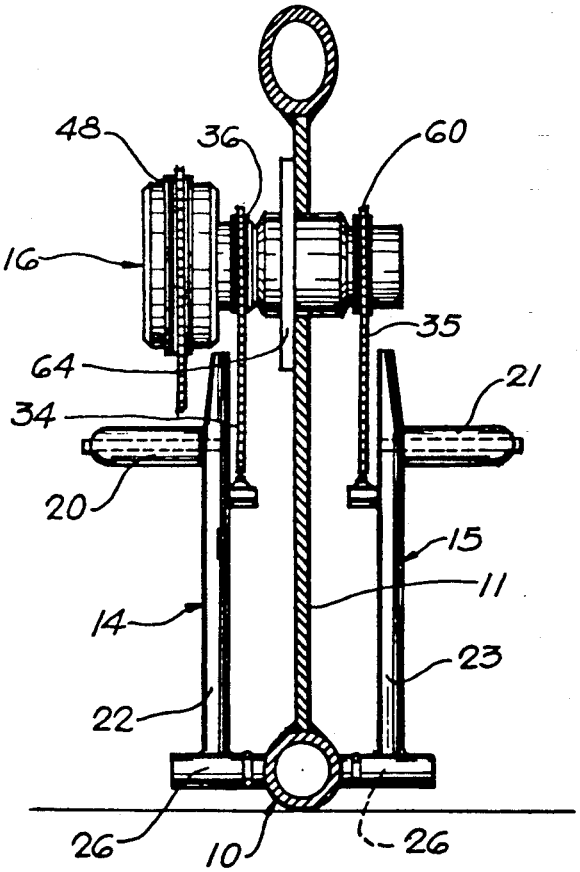
FIG. 2 is a sectional view taken along the line 2—2 of FIG. 1.

FIGS. 1 and 2 illustrate a stair climbing exercise machine having a tubular, generally triangular frame 10 with a wall 11 extending between opposite portions of the tubular portion of the frame. The frame 10 is provided with legs 12 adapted to rest on the floor of an exercise room. The frame 10 supports a pair of means 14 and 15 for separately converting the substantially linear motion of the right foot and left foot of the exerciser into rotary motion. In addition, the frame 10 supports a transmission 16 and a load 18. The frame 10 also has bars 19 to aid the exerciser in maintaining balance, and the bars 19 support a metering device, not shown, for providing the exerciser with a measurement of progress, but these elements are conventional and not fully illustrated.

The means 14 and 15 for converting substantially linear motion into rotary motion have flat steps 20 and 21, respectively, pivotally mounted on step arms 22 and 23, respectively, by means of bolts 24 journaled within the step and anchored on the step arm 22 or 23. The step 20 is mounted on the step arm 22 adjacent to one end thereof, and the other end of the step arm 22 is mounted pivotally on the frame 10 by a mounting post 26. FIG. 1 illustrates the structure for engaging the right foot of the exerciser, and the identical step 21 and step arm 23 are disposed on the opposite side of the wall 11 and mounted pivotally on the mounting post 26 for engaging the left foot of the exerciser.

One end of a chain 34 is attached to the step arm 22 centrally between the bolt 24 and the mounting post 26, and the chain 34 extends about a sprocket 36 journaled on a shaft 38. The other end of the chain 34 is attached to one end of an elongated spiral spring 40, and the spring 40 is attached at its other end to the wall 11 of the frame 10 by an anchor 46. The shaft 38 is journaled on the frame 10, and the sprocket 36 is mounted on a first input shaft or sleeve 52 which is journaled on the shaft 38 for rotation with respect to the frame 10. Hence, depressing the step 20 stretches the spring 40 and translates the chain 34 over the sprocket 36 to rotate the sleeve 52. The sleeve 52 is coupled to a second sprocket 48 through a one-way clutch to be described hereinafter.

The second sprocket 48 is coupled to a first drive sprocket 50 mounted on an input shaft 53 of a speed increaser 54 by a continuous chain 56. As a result, the energy used to depress the right step 20 results in rotation of the first input shaft 53 of the speed increaser 54.

In like manner, the second step 21 responds to force from the left foot of the exerciser and translates the chain 35 against a second elongated spiral spring, not shown, and over a second drive sprocket 60 to rotate the shaft 38 of the transmission 16. Shaft 38 is coupled to the second sprocket 48 by a second one-way clutch mechanism, to be described hereinafter, and hence force applied by the left foot of the exerciser appears as torque on the input shaft 53 of the speed increaser 54. The step 21, step arm 23, chain 35, sprocket 60 and second spiral spring are identical with the step 20, step arm 22, chain 34, sprocket 36, and spring 40 respectively, and are assembled to form a mirror image of FIG. 1 and perform the same functions as the structure of FIG. 1 for movement of the left foot.

Figure 3:
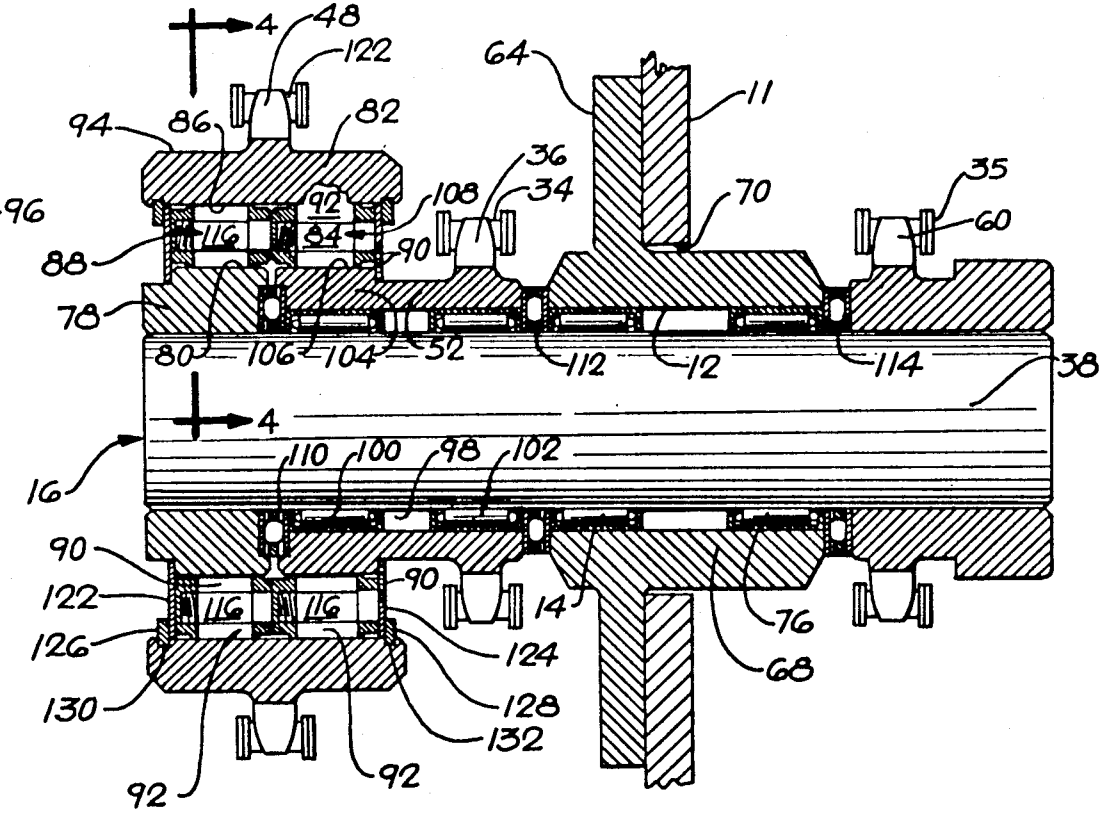
FIG. 3 is an axial section view of the transmission illustrated in FIG. 1 and constructed according to the present invention.

As illustrated in FIG. 3, the transmission 16 has a mounting flange 64 mounted on the wall 11 of the frame 10. The flange 64 has a hub 68 which extends through an opening 70 in the wall 11, and the hub 68 is provided with an axial channel 72 extending therethrough.

The second input shaft 38 extends through the axial channel 72 of the hub 68, and a pair of bearing assemblies 74 and 76 are disposed about the second input shaft 38 and journal the second input shaft 38 on the flange 64, thereby rotatably mounting the second input shaft 38 on the frame 10. A bushing 78 is secured at the end of the second input shaft 38 opposite the second drive sprocket 60, and the bushing 78 is provided with a cylindrical outer surface 80. A cylindrical shell 82 is disposed coaxially about the cylindrical surface 80, and the shell has a cylindrical channel 84 extending coaxially therethrough and forming an inner cylindrical surface 86. A cylindrical assembly 88 of one-way clutch members and ball bearings is disposed between the outer surface 80 of the bushing 78 and a first portion of the cylindrical inner surface 86 of the shell 82. The shell 82 has a cylindrical outer surface 94, and the output sprocket 48 extends outwardly from the outer cylindrical surface 94.

The first input shaft 52 has an axial channel 98 extending therethrough, and the first input shaft 52 is journaled about the second input shaft 38 on a pair of spaced bearing assemblies 100 and 102. The bearing assemblies 100 and 102 are disposed between the hub 68 of the mounting flange 64 and the bushing 78. The drive sprocket 36 is disposed at the one end of the first input shaft 52 adjacent to the hub 68, and the first input shaft is provided with a collar 104 at the other end thereof adjacent to the bushing 78. The collar 104 has a cylindrical outer surface 106 coaxial with the central axis of the first input shaft 52. A second assembly 108 of one-way clutch members is disposed between the outer surface 106 of the collar 104 and a second portion of the inner surface 86 of the shell 82. Thrust bearing assemblies 110, 112, and 114 are disposed about the second input shaft 38 between the bushing 78 and second input shaft 52, second input shaft 52 and the hub 68, and between the hub 68 and the second drive sprocket 60, respectively, to reduce rotational friction.

Figure 4:
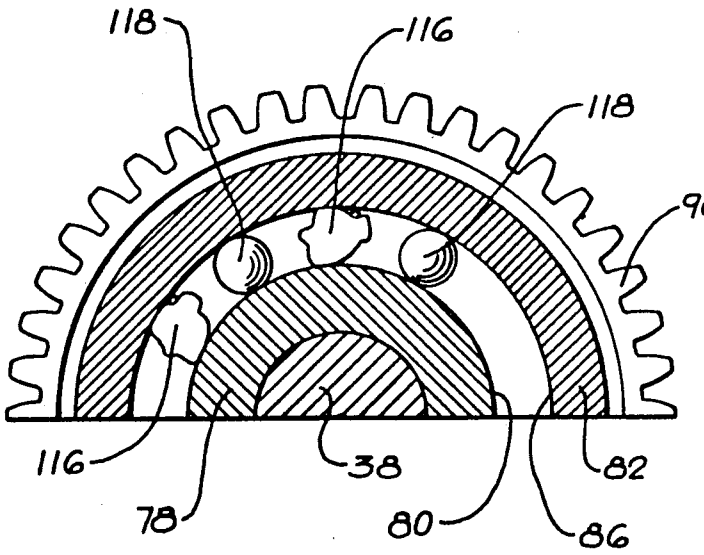
FIG. 4 is a sectional view taken along the line 4—4 of FIG. 3.

Each of the assemblies 88 and 108 of one-way clutch members is identical and has a plurality of clutch members 116 disposed between the surface 80 or 106 which forms an inner race and the surface 86 which forms an outer race of the clutch unit with their central axes parallel to the axis of the shell 82. In the particular one-way clutch assembly illustrated in FIG. 4, the clutch members 116 are of the sprag type, but the one-way clutches could also use rollers engaging inclined planes disposed on the surface of the inner race. Each of the assemblies 88 and 108 of one-way clutch members also is provided with a plurality of ball bearings 118, one ball bearing being mounted between each of the clutch members 116, thus forming ball bearing assemblies. These ball bearings 118 assure concentricity between the inner cylindrical surface 86 of the shell 82 and the cylindrical surface 80 of the bushing 78, respectively.

In the illustrated embodiment, the two assemblies of one-way clutch members 88 and 108 are aligned in abutment with each other, and they are maintained in position by two flat rings 122 and 124 disposed on opposite sides of the assemblies 88 and 108. The rings 122 and 124 are maintained in position by two retainer rings 126 and 128, respectively, which engage grooves 130 and 132 in the surface 86 of the shell 82.

Both of the one-way clutch assemblies 88 and 108 have their clutch members 116 positioned to pass torque in one, or the forward, rotational direction. Hence, torque applied to the first input shaft 52 by the right foot will drive the load 18 during periods when the left foot is being retracted on its step 21, and visa versa. The torque applied to the output sprocket 48 is thus a function of the sum of the torques applied to the input shafts 52 and 38.

The output sprocket 48 of the transmission 16 engages the continuous chain 56, and the chain 56 engages the sprocket 50 of the speed increaser 54 and thus drives the input shaft 53 thereof. The speed increaser 54 has an output shaft, not shown, which is coupled to an alternator 140 of the load 18 by the second continuous chain 134. The alternator 140 is electrically connected to a load resistor 142 which dissipates the power from the alternator 140 and permits the alternator 140 to function as a load on the steps 20 and 21.

Figure 5:
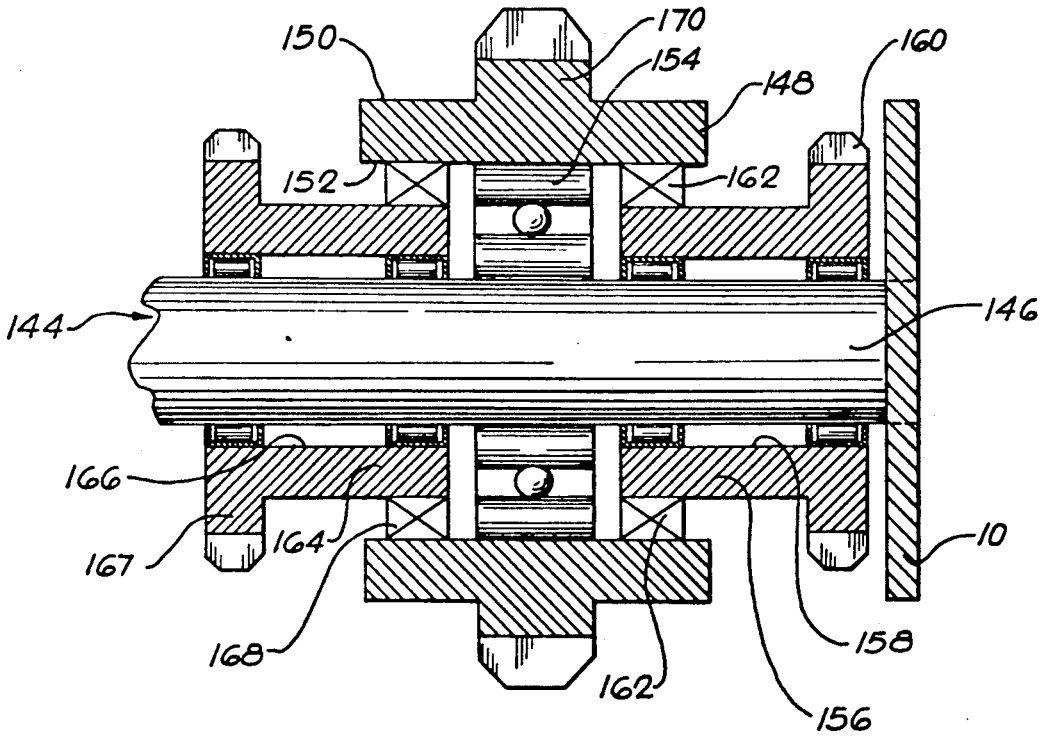
FIG. 5 is a diagramatic axial sectional view of a transmission which constitutes another embodiment of the present invention.

In the embodiment of FIG. 5, a transmission 144 is mounted on the frame 10 by a shaft 146 rigidly affixed on the frame. A shell 148 with an outer cylindrical surface 150 and an inner cylindrical surface 152 is journaled on the shaft 146 by a bearing assembly 154 which extends between the shaft 146 and the central portion of the inner surface 152 of the shell 148. A first sleeve 156 has an axial channel 158 and is journaled about the shaft 146 on one side of the bearing assembly 154. The first sleeve 156 has one cylinderical end disposed adjacent to the bearing assembly 154, and this end confronts a first portion of the inner cylindrical surface 152 of the shell 148. The other end of the first sleeve 156 carries a sprocket 160 for coupling to a first input means. A first one-way clutch assembly 162 is mounted on the first portion of the inner cylindrical surface 152 of the shell 148 and on the first sleeve 156.

A second sleeve 164 has an axial channel 166 and is journaled about the shaft 146 on the other side of the bearing assembly 154. The second sleeve 164 has one cylinderical end disposed adjacent to the bearing assembly 154, and this end confronts a second portion of the inner cylindrical surface 152 of the shell 148. The other end of the second sleeve 164 carries a sprocket 167 for coupling to a second input means. A second one-way clutch assembly 168 is mounted on the second portion of the inner cylindrical surface 152 of the shell 148 and on the second sleeve 164. The shell 148 carries the combined output from the two input sleeves 156 and 164, and the outer surface of the shell 148 is provided with a sprocket 170. The one-way clutch assemblies 162 and 168 are preferably of the sprag type illustrated in FIG. 4, but no ball bearings are required in the one-way clutch assemblies 162 and 168.

Figure 6:
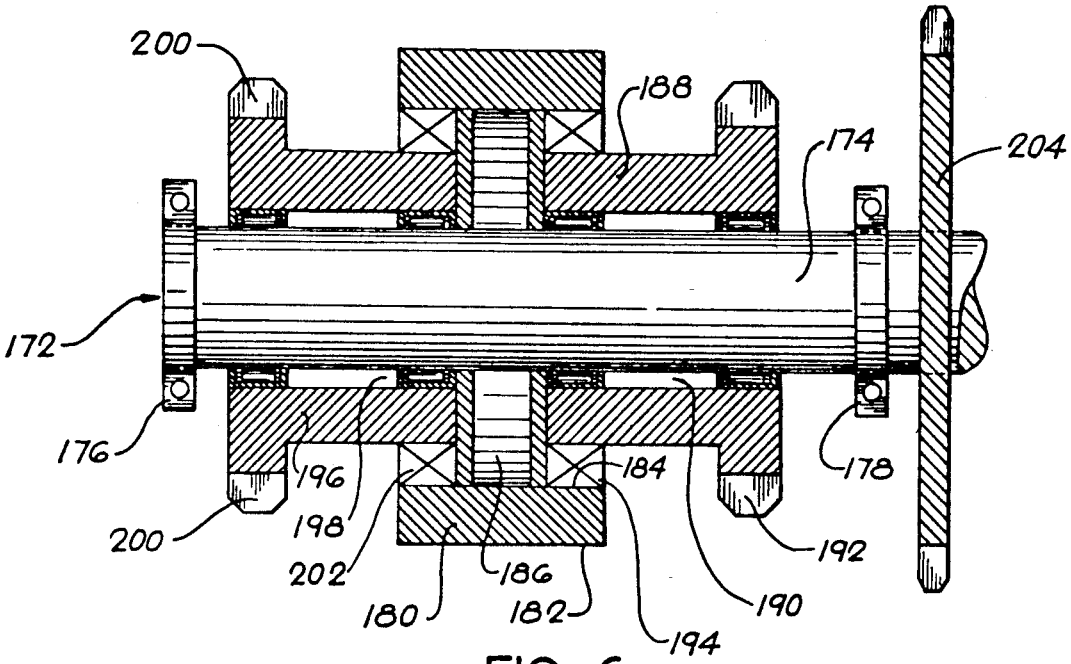
FIG. 6 is a diagramatic axial sectional view of a transmission which constitutes still another embodiment of the present invention.

In the embodiment of FIG. 6, a transmission 172 is mounted on the frame 10 by a shaft 174 which is journaled on the frame by a pair of clamps 176 and 178. A shell 180 with an outer cylindrical surface 182 and an inner cylindrical surface 184 is securely mounted on the shaft 174 by a cylindrical block 186 which extends between the shaft 174 and the central portion of the inner surface 184 of the shell 180. A first sleeve 188 has an axial channel 190 and is journaled about the shaft 174 on one side of the block 186. The first sleeve 188 has one cylindrical end disposed adjacent to the block 186, and this end confronts a first portion of the inner cylindrical surface 184 of the shell 180. The other end of the first sleeve 188 carries a sprocket 192 for coupling to a first input means. A first one-way clutch assembly 194 is mounted on the first portion of the inner cylindrical surface 184 of the shell 180 and on the first sleeve 188.

A second sleeve 196 has an axial channel 198 and is journaled about the shaft 174 on the other side of the block 186. The second sleeve 196 has one cylindrical end disposed adjacent to the block 186, and this end confronts a second portion of the inner cylindrical surface 184 of the shell 180. The other end of the second sleeve 196 carries a sprocket 200 for coupling to a second input means. A second one-way clutch assembly 202 is mounted on the second portion of the inner cylindrical surface 184 of the shell 180 and on the second sleeve 196. The shell 180 carries the combined output from the two input sleeves 188 and 196, and the block 186 transmits this output to the shaft 174. The one-way clutch assemblies 194 and 202 are preferably of the sprag construction illustrated in FIG. 4, but no ball bearings are required in this construction. A sprocket 204 is mounted on the shaft 174.

Those skilled in the art will recognize other applications and constructions for the transmission of the present invention and the exercise machine of the present invention. It is therefore intended that the scope of the present invention be not limited by the foregoing specification, but rather only by the appended claims.

The invention claimed is:

1. An assembly for converting a first rotary input and a second rotary input into a single rotary output comprising a first rotatable input shaft having an central axis of elongation and being adapted to be coupled to the first rotary input, a second rotatable input shaft having a central axis of elongation and being adapted to be coupled to the second rotary input, a shell having an inner and outer surface, the inner surface of the shell having a central axis of elongation, means for mounting the first and second shafts and the shell with their respective axes of elongation on a common axis, the first and second shafts and shell being rotatable on said common axis, a first portion of the inner surface of the shell being spaced from and confronting the first shaft, a second portion of the inner surface of the shell being spaced from and confronting the second shaft, a first one-way clutch means disposed between the first portion of the shell and the first shaft, said first one-way clutch means transmitting torque from the first shaft to the shell in one rotational direction and free wheeling in the opposite rotational direction, and a second one-way clutch means disposed between the second portion of the inner surface of the shell and the second shaft, said second one-way clutch means transmitting torque from the second shaft to the shell in the one rotational direction and free wheeling in the reverse direction, whereby the torques of the first and second shafts in the one rotational direction are combined at the shell.

2. An assembly for converting a first rotary input and a second rotary input to a single rotary output comprising the elements of claim 1 wherein the second shaft comprises a cylindrical sleeve disposed about and rotatably mounted on the first shaft.

3. An assembly for converting a first rotary input and a second rotary input to a single rotary output comprising the elements claim 2 wherein the means for mounting the first and second shafts and the shell comprises a support structure having a plate with an opening therein, a flange mounted on the plate, said flange having an aperture confronting the opening in the plate, the first shaft being journaled within the aperture of the flange.

4. An assembly for converting a first rotary input and a second rotary input to a single rotary output comprising the elements of claim 3 in combination with means disposed on one side of the plate and mounted on the first shaft for coupling the first shaft to the rotary input.

5. An assembly for converting a first rotary input and a second rotary input to a single rotary output comprising the elements of claim 3 in combination with means disposed on the other side of the plate and mounted on the second shaft for coupling the second shaft to the second rotary input.

6. An assembly for converting a first rotary input and a second rotary input to a single rotary output comprising the elements of claim 4 wherein the means for coupling the first shaft to the first rotary input comprises a sprocket.

7. An assembly for converting a first rotary input and a second rotary input to a single rotary output comprising the elements of claim 4 wherein the means for coupling the second shaft to the second rotary input comprises a sprocket.

8. An assembly for converting a first rotary input and a second rotary input to a single rotary output comprising the elements of claim 1 wherein the shell is provided with means on its exterior surface to couple the shell to a load.

9. An assembly for converting a first rotary input and a second rotary input to a single rotary output comprising the elements of claim 2 wherein the first one-way clutch means comprises a first inner race mounted on the first shaft, and a first outer race mounted on the first portion of the shell, and an assembly disposed between the inner and outer races having a plurality of spaced clutch members disposed between the inner and outer races.

10. An assembly for converting a first rotary input and a second rotary input to a single rotary output comprising the elements of claim 2 wherein the second one-way clutch means comprises a second inner race mounted on the second shaft, and a second outer race mounted on the second portion of the shell, and a second assembly disposed between the second inner and second outer races having a second plurality of clutch members disposed between the second inner and second outer races.

11. An assembly for converting a first rotary input and a second rotary input to a single rotary output comprising the elements of claim 2 wherein the first one-way clutch means comprises a bearing assembly mounted between the first shaft and the first portion of the shell.

12. An assembly for converting a first rotary input and a second rotary input to a single rotary output comprising the elements of claim 2 wherein the second one-way clutch means comprises a second bearing assembly mounted between the second shaft and the second portion of the shell.

13. An assembly for converting a first rotary input and a second rotary input into a single rotary output comprising the elements of claim 1 wherein the shell has a third portion adjacent to the first and second portions thereof and spaced from and confronting a shaft disposed on the axis of the shell, in combination with a bearing assembly disposed between the shaft on the axis of the shell and the third portion of the shell.

14. An assembly for converting a first rotary input and a second rotary input into a single rotary output comprising the elements of claim 13 wherein the shaft on the axis of the shell is secured on the frame, and the first shaft has an axial channel accommodating the shaft on the axis of the shell and is journaled thereon.

15. An assembly for converting a first rotary input and a second rotary input into a single rotary output comprising the elements of claim 1 wherein the shell has a third portion adjacent to the first and second portions thereof and a third shaft is disposed on the axis of the shell, in combination with a block mounted on the third portion of the shell and the third shaft, whereby the third shaft rotates in response to the first and second shafts.

16. An exercise device comprising a first manually actuable member and a second manually actuable member, said members being alternately and manually moved between one position and another position, a first means having a first shaft for converting movement into rotational motion coupled to the first member, a second means having a second shaft for converting movement into rotational motion coupled to the second member, means for combining the first input on the first shaft and the second input on the second shaft into an output on a third shaft comprising a shell, means for mounting the first and second shafts and the shell for rotation about a common axis, the shell being spaced from the first and second shafts, a first portion of the shell confronting the first shaft and a second portion of the shell confronting the second shaft, a first one-way clutch means disposed between the first portion of the shell and the first shaft, said first one-way clutch means transmitting rotary motion from the first shaft to the shell in one rotational direction and free wheeling in the opposite rotational direction, and a second one-way clutch means disposed between the second portion of the shell and the second shaft, said second one-way clutch means transmitting rotary motion from the second shaft to the shell in the one rotational direction and free wheeling in the reverse direction, whereby the rotational motion of the first and second shafts in the one rotational direction are combined on the shell, and the shell is adapted to be coupled to a load.

* * * * *